US010492630B2

(12) United States Patent
Artwohl et al.

(10) Patent No.: US 10,492,630 B2
(45) Date of Patent: Dec. 3, 2019

(54) PLASTIC PANEL DOOR

(71) Applicant: Anthony, Inc., Sylmar, CA (US)

(72) Inventors: Paul J. Artwohl, Stevensville, MI (US); Jeffery W. Nicholson, Palmdale, CA (US); Jun Huh, Sylmar, CA (US)

(73) Assignee: Anthony, Inc., Sylmar, CA (US)

( * ) Notice: Subject to any disclaimer, the term of this patent is extended or adjusted under 35 U.S.C. 154(b) by 0 days.

(21) Appl. No.: 15/905,496

(22) Filed: Feb. 26, 2018

(65) Prior Publication Data

US 2019/0261785 A1 Aug. 29, 2019

(51) Int. Cl.

| | |
|---|---|
| ***A47F 3/04*** | (2006.01) |
| ***E06B 3/86*** | (2006.01) |
| ***E06B 5/00*** | (2006.01) |
| *E06B 3/70* | (2006.01) |
| *F25D 23/02* | (2006.01) |

(52) U.S. Cl.

CPC ..... *A47F 3/0434* (2013.01); *E06B 3/86* (2013.01); *E06B 5/006* (2013.01); *E06B 2003/7049* (2013.01); *F25D 23/028* (2013.01)

(58) Field of Classification Search

CPC . A47F 3/04; A47F 3/0434; E06B 3/86; E06B 5/006

USPC ..... 312/114, 116, 138.1; 62/440

See application file for complete search history.

(56) References Cited

U.S. PATENT DOCUMENTS

| | | | | |
|---|---|---|---|---|
| 1,998,500 | A | 4/1935 | Fritz | |
| 5,034,173 | A | 7/1991 | Altman et al. | |
| 5,533,311 | A | 7/1996 | Tirrell et al. | |
| 5,800,651 | A | 9/1998 | Williamson | |
| 2010/0068398 | A1 | 3/2010 | Roche et al. | |
| 2011/0165399 | A1 | 7/2011 | Cording | |
| 2011/0273065 | A1* | 11/2011 | Dickey | A47F 3/043 312/138.1 |
| 2015/0245720 | A1* | 9/2015 | Isfort | A47F 3/0434 312/116 |
| 2016/0073792 | A1 | 3/2016 | Bouwman | |

FOREIGN PATENT DOCUMENTS

| | | |
|---|---|---|
| EP | 602755 | 4/1996 |
| WO | WO2013/133707 | 9/2013 |
| WO | WO2016/068694 | 5/2016 |

OTHER PUBLICATIONS

"Starlight Skylight acrylic assemblies," Retrieved from (http://starlightskylights.com/products-curbmount.html?variation=distributor), year 2018, 6 pages.

* cited by examiner

*Primary Examiner* — James O Hansen

(74) *Attorney, Agent, or Firm* — Fish & Richardson P.C.

(57) ABSTRACT

A display case door includes a panel assembly with a first transparent pane and a second transparent pane. The first transparent pane includes flanges extending from each of a first edge and a second edge of a shaped portion. The second transparent pane is adhered to both flanges of the first pane to define a space between facing surfaces of the second transparent pane and the shaped portion of the first transparent pane and extending between openings at opposite ends of the panel assembly. Caps are coupled to the panel assembly and cover the openings at each of the first end and second end. The door further includes a hinge coupled to one of the flanges, a door handle secured to a surface of one of the flanges, and an edge guard coupled along an edge of at least one of the flanges.

14 Claims, 5 Drawing Sheets

PLASTIC PANEL DOOR

TECHNICAL FIELD

This invention relates to thermally insulated doors for temperature controlled environments.

BACKGROUND

Refrigerated enclosures are used in commercial, institutional, and residential applications for storing and/or displaying refrigerated or frozen objects. Refrigerated enclosures may be maintained at temperatures above freezing (e.g., a refrigerator) or at temperatures below freezing (e.g., a freezer). Refrigerated enclosures have one or more thermally insulated doors or windows for viewing and accessing refrigerated or frozen objects within a temperature-controlled space. Doors for refrigerated enclosures generally include thermally insulated glass panel assemblies.

In some circumstances, plastic door assemblies may provide advantages over glass panel assemblies. However, plastic panel doors can be more expensive than glass to mold and manufacture.

SUMMARY

In a first general aspect, innovative features of the subject matter described in this specification can be embodied a display case door. The door includes a panel assembly including a first transparent pane and a second transparent pane. The first transparent pane includes, in cross-section, respective flanges extending from each of a first edge and a second edge of a shaped portion, where the shaped portion extends out of a plane formed by the flanges. The second transparent pane is adhered to both flanges of the first pane to define a space between facing surfaces of the second transparent pane and the shaped portion of the first transparent pane and extending between openings at opposite ends of the panel assembly. Caps are coupled to the panel assembly and cover the openings at each of the first end and second end. Each of the caps includes a body portion and a cap flange. The body portion is shaped to correspond with the cross-section of the panel assembly and is configured to couple to both the first transparent pane and the second transparent pane at an end of the panel assembly, thereby, covering one of the openings. The cap flange extends away from the body portion of the cap. The door further includes a hinge coupled to one of the flanges of the first transparent pane, a door handle secured to a surface of one of the flanges of the first pane, and an edge guard coupled along an edge of at least one of the flanges, where the edge guard includes a flexible wiper configured to form a seal with another surface with the door in a closed position. This and other implementations can each optionally include one or more of the following features.

In some implementations, the first pane comprises acrylic or polyethylene terephthalate (PETG).

In some implementations, the second pane is welded to the flanges.

In some implementations, the flanges and shaped portion, together, form a top hat-shaped cross-section.

In some implementations, the handle is secured to the surface of the one of the flanges with an adhesive.

In some implementations, the handle is secured to the one of the flanges with a mechanical fastener.

In some implementations, edges of the second pane are substantially coextensive with edges of the flanges of the first pane.

In some implementations, the first pane is an extruded plastic material having a substantially constant cross-section along its length parallel to the flanges.

In some implementations, the caps are coupled with an adhesive

In some implementations, the caps are mechanically coupled to the panel assembly.

In a second general aspect, innovative features of the subject matter described in this specification can be embodied in installation methods for a display case door that include the actions of trimming a panel assembly, where the panel assembly includes a first pane and a second pane. The first pane includes, in cross-section, a flange extending from each of a first edge and a second edge of a shaped portion, the shaped portion extending out of a plane formed by the flanges. The second pane a second pane is adhered to both flanges of the first pane forming a space between the respective facing surfaces of the second pane and the shaped portion of the first pane and openings at first end and second end of the panel assembly. Trimming the panel assembly includes cutting the panel assembly to a desired height by cutting across the panel assembly substantially parallel to one of the openings and from one of the flanges to the other of the flanges. Installing caps over the openings at the first end and the second end of the trimmed panel assembly, where each cap includes a body portion shaped to correspond with the cross-section of the panel assembly with a cap flange extending away from the body portion. This and other implementations can each optionally include one or more of the following features.

In some implementations, the trimming further comprises cutting the panel assembly to a desired width by trimming at least one of the flanges.

In some implementations, the method includes installing the hinges on the cap flange.

In some implementations, the method includes installing the door into a frame of a display case.

In some implementations, the method includes installing a handle on the panel assembly.

In some implementations, the method includes installing edge guards along respective edges of the flanges.

In a first general aspect, innovative features of the subject matter described in this specification can be embodied a display case including a frame with a first display case door and a second display case door mounted to the frame. Each of the first display case door and the second display case door include a panel assembly with caps coupled to the panel assembly. The panel assembly includes a first transparent pane and a second transparent pane. The first transparent pane includes, in cross-section, respective flanges extending from each of a first edge and a second edge of a shaped portion, the shaped portion extending out of a plane formed by the flanges. The second transparent pane is adhered to both flanges of the first pane to define a space between facing surfaces of the second transparent pane and the shaped portion of the first transparent pane and extending between openings at opposite ends of the panel assembly. The caps are coupled to the panel assembly and cover the openings at each of the first end and second end. Each of the caps includes a body portion and a cap flange. The body portion is shaped to correspond with the cross-section of the panel assembly and configured to couple to both the first transparent pane and the second transparent pane at an end of the panel assembly, thereby, covering one of the openings.

The cap flange extends away from the body portion. Each of the doors further include a hinge coupled to one of the flanges of the first pane and the hinge is configured to couple to the hinge receiving portion of the frame, a door handle secured to a surface of one of the flanges of the first pane, and an edge guard coupled along an edge of at least one of the flanges where the edge guard includes a flexible wiper. The first door and the second door are positioned within the frame such that the flexible wiper of the first door forms a seal with the flexible wiper of the second door of each door, with both doors in a closed position. This and other implementations can each optionally include one or more of the following features.

In some implementations, edges of the second pane are substantially coextensive with edges of the flanges of the first pane.

In some implementations, the first pane is an extruded plastic material having a substantially constant cross-section along its length parallel to the flanges.

In some implementations, the flanges and shaped portion, together, form a top hat-shaped cross-section.

The concepts described herein may provide several advantages. For example, implementations of the invention may a size configurable plastic panel assembly for a refrigerated cabinet door. For example, the plastic panel assembly may be molded in only two dimensions, thereby, permitting more efficient use of materials and more cost effective molding and manufacturing techniques. Furthermore, the plastic panel may permit customization of door sizes at the installation site instead of at the manufacturer. The ability to customize door sizes at the installation site may provide improved door fit, e.g., for retrofitting doors to existing cases. Improved door fit may translate to better thermal insulation and improved energy efficiency.

Implementations may provide lighter weight doors compared to existing glass panel doors. Implementations provide improved consumer safety. For example, plastic panel doors may be shatterproof. Implementations may provide improved thermal insulation compared to some glass panel doors. Implementations may be entirely or nearly entirely transparent, thereby, improving the visibility of products displayed behind the door while jointly improving energy efficiency of a refrigerated cabinet.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
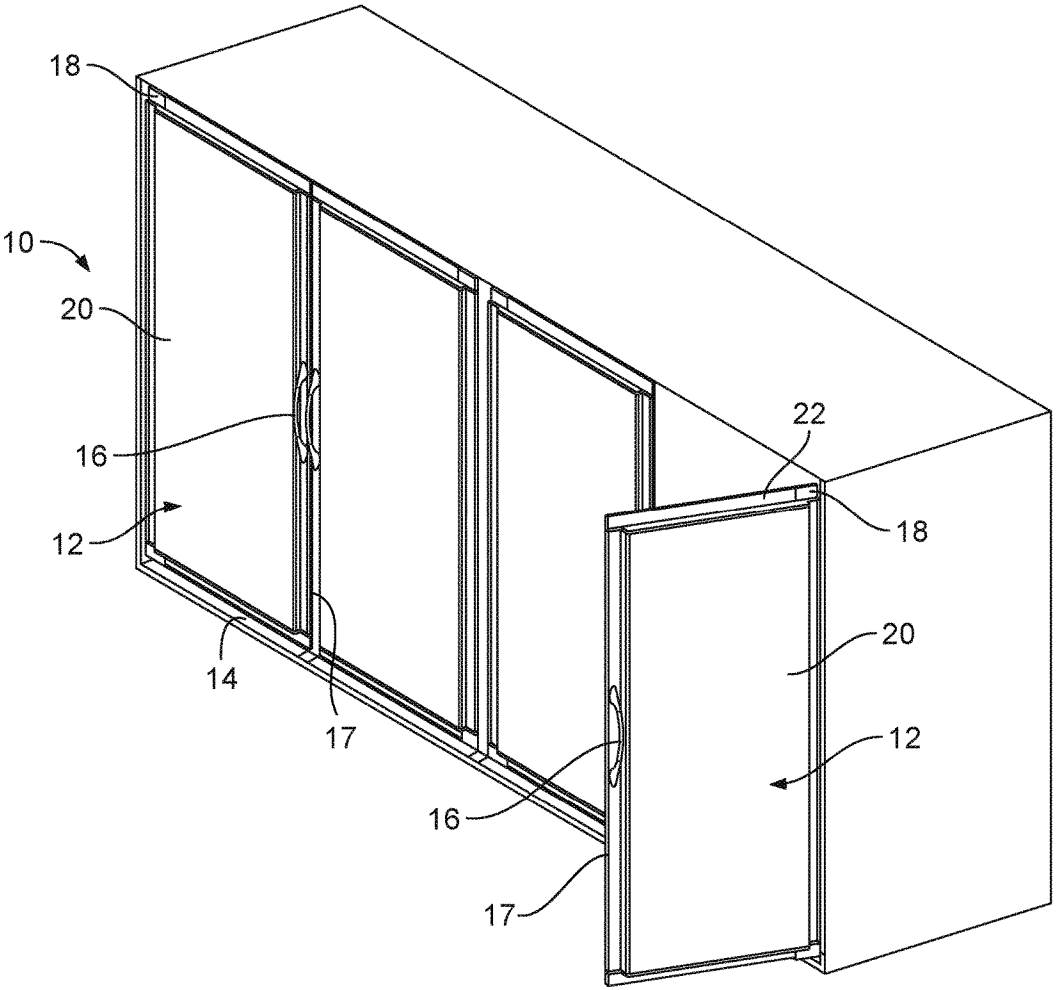
FIG. 1 is a perspective view of a refrigerated display case including display case doors.

FIG. 1 illustrates an exemplary refrigerated display case 10 that includes transparent display case doors 12 installed therein. The refrigerated display case 10 may be a refrigerator, freezer, or other enclosure defining a temperature-controlled space. For example, refrigerated display case 10 may be a refrigerated display case or refrigerated merchandiser in grocery stores, supermarkets, convenience stores, florist shops, and/or other commercial settings to store and display temperature-sensitive consumer goods (e.g., food products, flowers, etc.). Refrigerated display case 10 can be used to display products that must be stored at relatively low temperatures and can include shelves, transparent doors, and/or transparent walls to permit viewing of the products supported by the shelves. In some implementations, refrigerated display case 10 is a refrigerated display unit used, for example, in warehouses, restaurants, and lounges. For example, refrigerated display case 10 can be a free standing unit or "built in" unit that forms a part of the building in which the refrigerated display case 10 is located.

As illustrated, refrigerated display case 10 has multiple display case doors 12 mounted on a frame 14. Each door 12 is pivotally mounted on hinges 18 that connect the door 12 to frame 14. In some implementations, doors 12 can be sliding doors configured to open and close by sliding with respect to case frame 14. For example, hinges 18 can be replaced by a pair of corresponding rails coupled, respectively, to each door 12 and frame 14.

Figure 3:
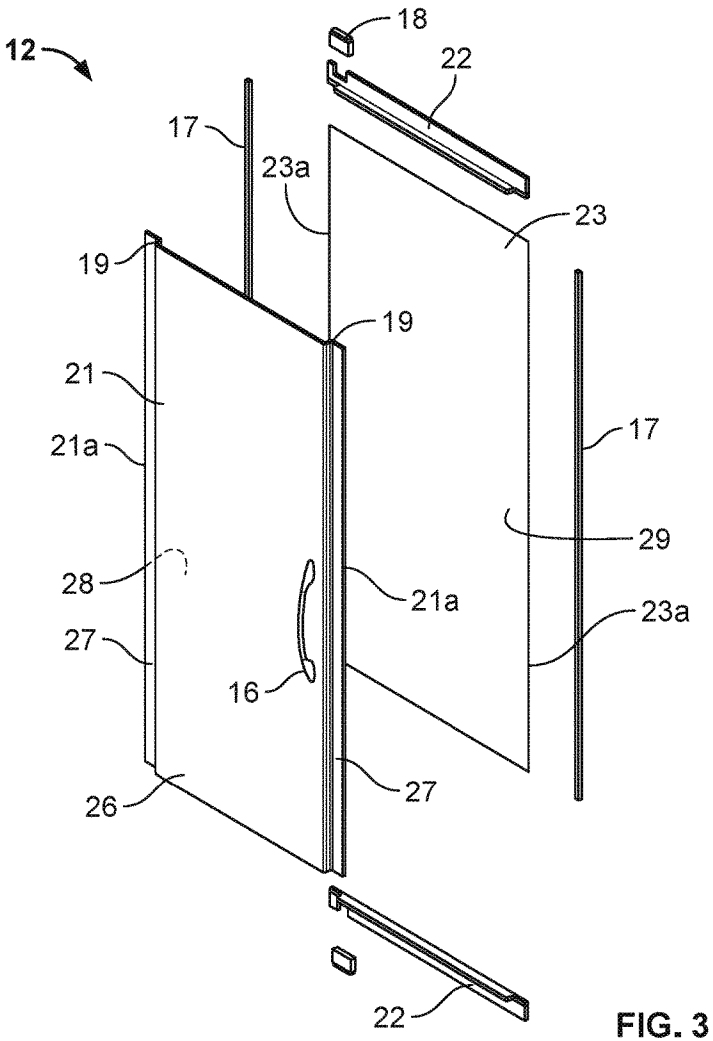
FIG. 3 is an exploded view of the display case door shown in FIG. 2.
Figure 2:
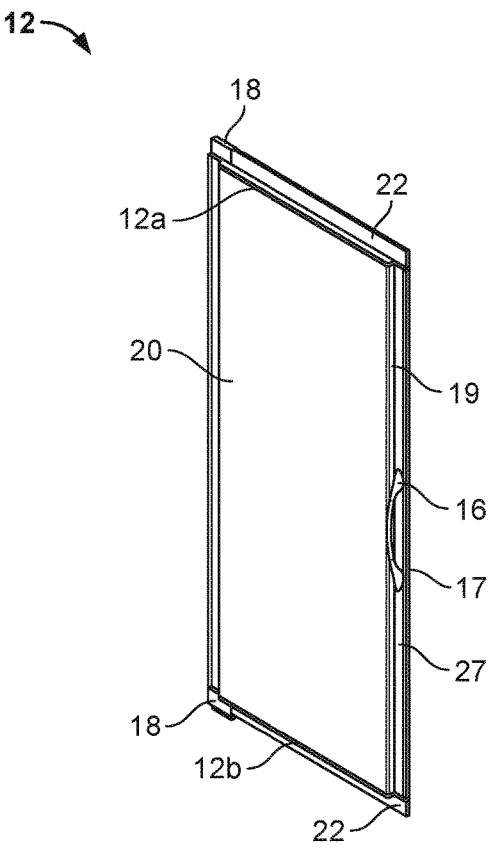
FIG. 2 is a perspective view of a display case door.
Figure 4:
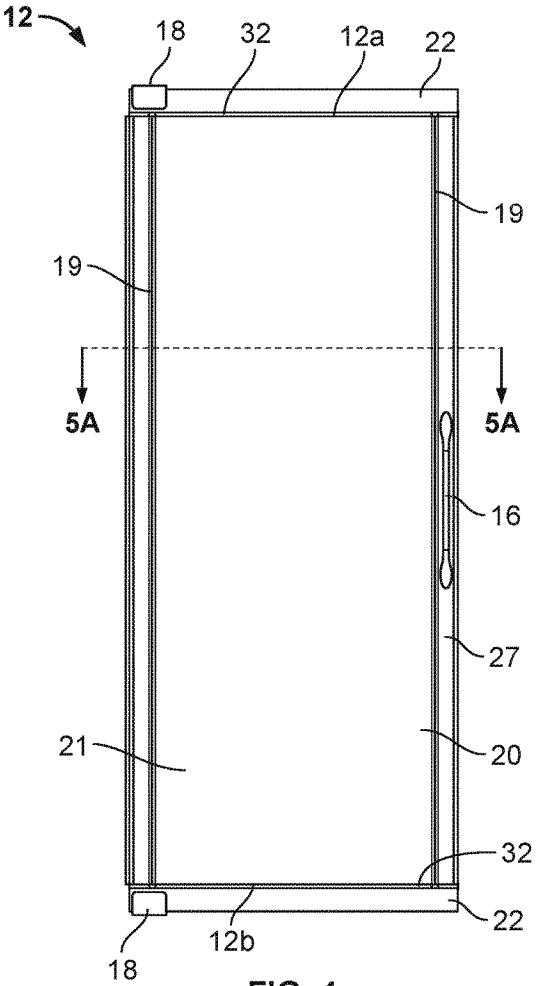
FIG. 4 is a front elevation view of the display case door shown in FIG. 2.

Referring to FIGS. 2-4, display case door 12 includes a panel assembly 20, caps 22, a door handle 16, and edge guards 17. As shown in FIG. 3, panel assembly 20 includes two transparent panes 21 and 23. Panes 21 and 23 are transparent plastic panes. For example, the plastic used to make pane 21 and pane 23 may include polycarbonate, acrylic, or polyethylene terephthalate (PETG). For example, the use of plastic instead of glass may provide lighter weight and more thermally efficient doors 12. In some implementations, the plastic used to make panes 21 and 23 can be shatterproof plastic.

Panes 21 and 23 are coupled together to form panel assembly 20. Panes 21 and 23 are configured to define a space between their respective inner surfaces 28 and 29 when the two panes 21 and 23 are joined. For example, pane 21 includes a shaped portion 26 with two flanges 27 extending outward from the shaped portion 26. The flanges 27 provide a mating surface for joining pane 21 with pane 23. The shaped portion 26 is arranged to extend away from pane 23, thereby, defining the space between the two panes 21 and 23. In some implementations, flanges 27 form a plane (not shown) from which the shaped portion 26 extends. In other words, both flanges 27 can be positioned substantially within a common plane with the shaped portion 26 extending outside of the plane formed by the flanges 27.

Pane 23 can be a substantially flat pane, as illustrated. Pane 23 is joined to pane 21 by being adhered to flanges 27 of pane 21. For example, pane 23 is approximately the same width and length as pane 21 such that edges 23*a* of pane 23 are substantially coextensive with edges 21*a* at each end of flanges 27. Pane 23 can be adhered to flanges 27 of pane 21 using, e.g., an adhesive or by welding/bonding. Inner surfaces 28 and 29 are exposed to the space formed between panes 21 and 23.

Figure 5A:
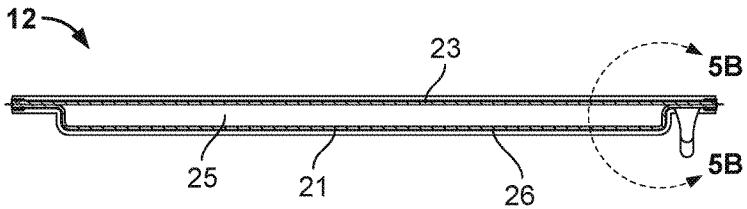
FIG. 5A is a cross-sectional plan view of the display case door shown in FIG. 2 taken along line 5A-5A in FIG. 4.
Figure 5B:
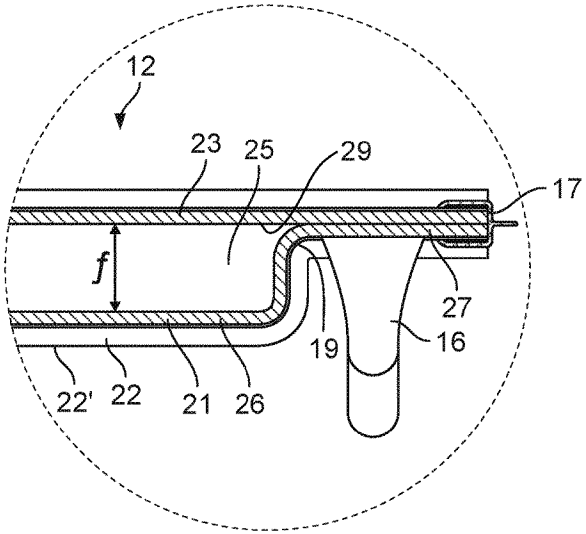
FIG. 5B is an enlarged view of area 5B in FIG. 5A.

Referring to FIG. 4, pane 21 (and by extension panel assembly 20) has a substantially constant cross-section along its length (e.g., the distance parallel with flanges 27). For example, referring also to FIGS. 5A and 5B, the shaped portion 26 of pane 21 forms a space 25 with a substantially constant distance (FIG. 5B) between pane 21 and pane 23 along the length of panel assembly 20. As shown in FIG. 5B, flange 27 extends from edge 19 of shaped portion 26 and is adhered to a portion of the inner surface 29 of pane 23, forming a substantially constant cross-section including the space 25 that extends along the length of panel assembly 20. The shape of cap 22 coincides with the cross-section of door 12, having an edge 22' that extends generally parallel to the contour of the cross-section of door 12.

Pane 21 can be made of an extruded plastic material with a constant cross-section along its length parallel to flanges 27. In some implementations, pane 21 may be made using a different method such as vacuum forming or compression molding. The shaped portion 26 is illustrated as forming a "U-shape" which, together with the flange 27 forms a "top-hat" shaped cross-section along the length of pane 21. In some implementations, shaped portion 26 may be formed to have different shapes (e.g., an arched-shape).

Panel assembly 20 has an opening at each end 12*a* and 12*b*. The openings are covered by caps 22 (as shown in FIGS. 2 and 4). Caps 22 are coupled to top end 12*a* and bottom end 12*b* of the panel assembly to covering the openings formed between the panes 21 and 23 at both ends of panel assembly 20. Caps 22 may be coupled to panel assembly 20 by using an adhesive or by mechanical coupling (e.g., snap fit/friction fit).

Figure 6B:
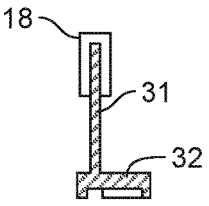
FIG. 6B is a side view of the cap shown in FIG. 6A
Figure 6A:
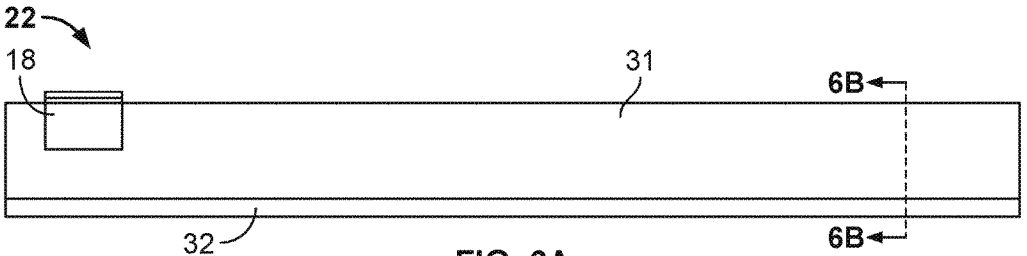
FIG. 6A is a front view of a cap.
Figure 6C:
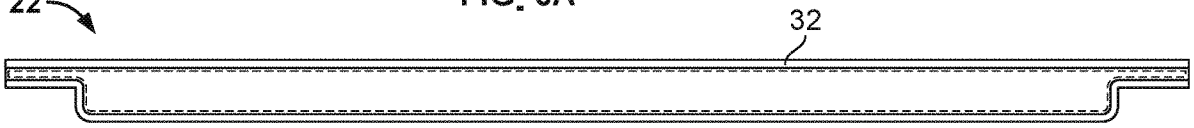
FIG. 6C is a bottom view of the cap shown in FIG. 6A.

FIGS. 6A-C illustrate details of a cap 22. Cap 22 can be a molded plastic material. Cap 22 includes a body portion 32, a cap flange 31, and a hinge 18 attached to flange 31. The body portion 32 is the portion of molded cap 22 that comes into direct contact with the panel assembly 20. Body portion 32 is shaped to correspond with the cross-section of the panel assembly 20. The body portion 32 is configured to couple to both panes 21 and 23 at respective ends of panel assembly 20, thereby, covering the top and bottom opening of panel assembly 20 (as shown in FIG. 4). Body portion 32 may be configured to couple to the panel assembly by using an adhesive or by using a mechanical coupling (e.g., snap fit/friction fit).

Cap 22 also includes cap flange 31 that extends away from body portion 32. Flange 31 provides a structure for attaching hardware (e.g., hinges or slide rails) for mounting door 12 within frame 14. For example, hinge 18 is coupled to the cap flange 31 for connecting the display case door 12 to the display case frame 14, as shown in FIG. 1. In some implementations, a rail or a different type of door hinge may be mounted to flange 31. In some implementations, caps 22 may be constructed of multiple parts mechanically fastened together. In some implementations, a hinge rail may be coupled to one of the flanges 27 of the panel assembly 20.

Door handle 16 is secured to the surface of one of the flanges 27 of pane 21. Handle 16 may be attached to panel assembly 20 by using an adhesive or epoxy. In some implementations, handle 16 can be secured to panel assembly 20 with mechanical fasteners (e.g., bolt/screw). Handle 16 may be used to open, close, lock, unlock, seal, unseal, or otherwise operate display case door 12. Handle 16 can be made from extruded aluminum tubes that are cut to a specified dimension and bonded to a surface of panel assembly 20. Handle 16 is illustrated as being attached to the outer surface of pane 21, however, in some implementations, handle 16 can be attached to the outer surface of pane 23.

Edge guards 17 are coupled to panel assembly 20. Edge guards 17 may protect, seal and/or improve the aesthetic appearance of door 12. Edge guards 17 are coupled to an edge of flanges 27. Edge guards 17 can include a flexible wiper configured to form a seal with another surface or another edge guard with the door in a closed position (see FIG. 1). For example, two edge guards from adjacent doors in a closed position cooperate with each other to establish a seal. In some implementations, edge guards 17 can form a seal with frame 14, a mullion, or a sidewall of a refrigerated cabinet. The seal may be formed by edge guard 17 pressing firmly and uniformly against a surface adjacent the edge of door 12. This implementation prevents air enclosed in refrigerated case 10 from mixing with ambient air when door 12 is closed.

In some implementations, panel assembly 20 may be used as part of a door 12 configured to provide a thermal insulation (e.g., for a refrigerated display case) or otherwise used as any type of transparent or substantially transparent panel that provides a thermal insulation effect (e.g., a sliding or hinged window, a fixed-position window, a revolving or sliding door, a hinged door, etc.). In some implementations, panel assembly 20 may be used as an insulated window for a refrigerated display case.

Figure 7:
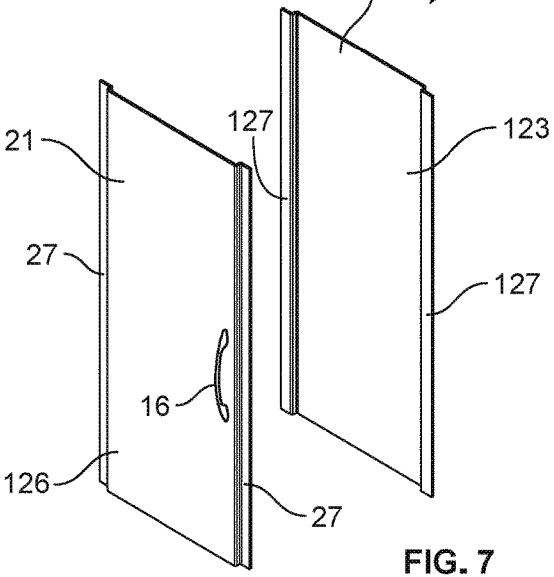
FIG. 7 is a partial exploded view of a display case door having shaped panes.

FIG. 7 illustrates a different implementation of a panel assembly 20. A panel assembly 120 includes two panes 21 and 123 that each have a shaped portion 126. For example, panes 21 and 123 can each include shaped portions 126 that form a 'top hat-shaped' cross-section. For example, panel assembly 120 includes a second pane 123 similar to pane 21, having a shaped portion 126 and flanges 127 extending from each side of the shaped portion. In this configuration, when both panes 21 and 123 are coupled together, flanges 27 and 127 adhere to one another, forming a larger gap between both shaped portions 126 compared to the gap 25 formed between both panes of the panel assembly in FIG. 5A. Handle 16 is illustrated as being attached to the outer surface of pane 21, however, in some implementations, handle 16 can be attached to the outer surface of pane 123.

Figure 8:
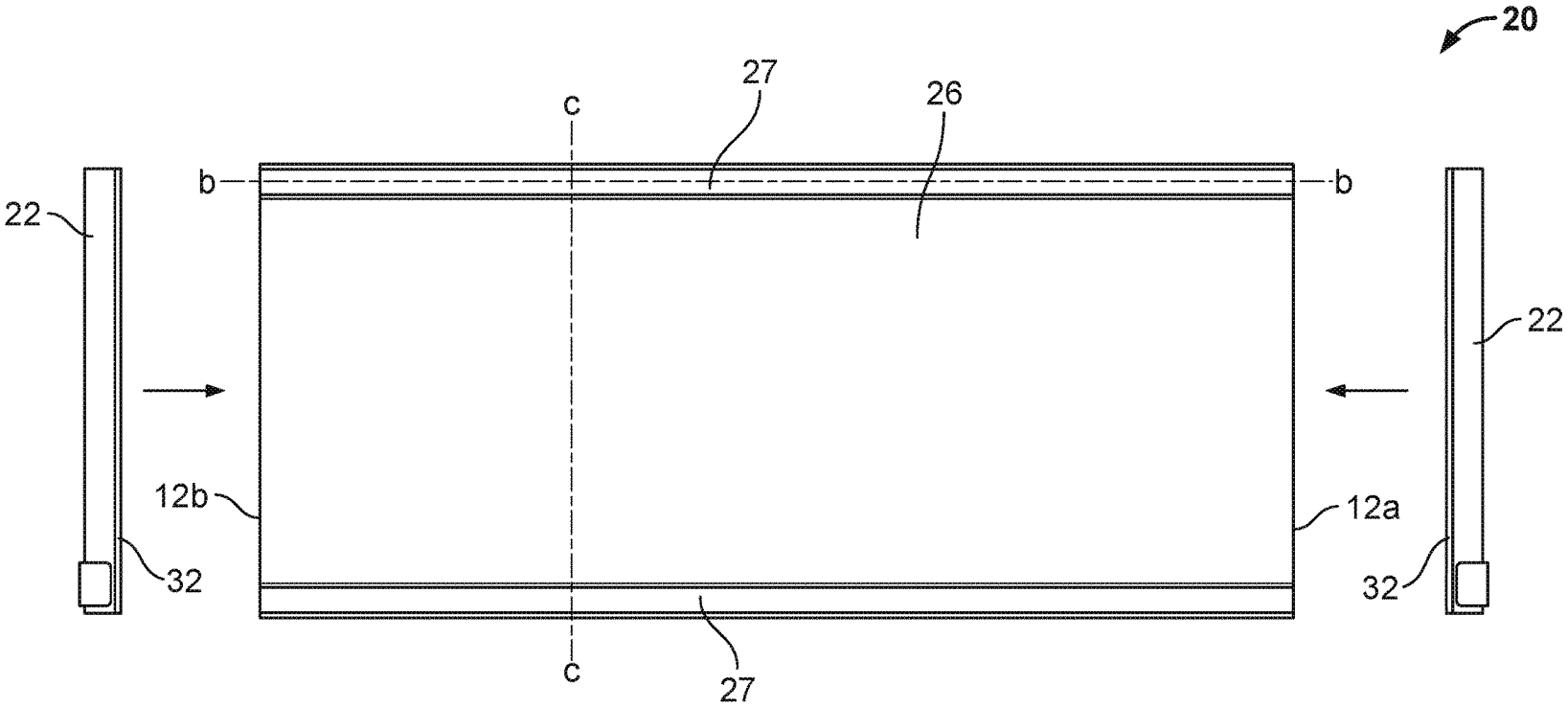
FIG. 8 is a diagram illustrating an exemplary assembly process for a display case door according to implementations of the present disclosure.

FIG. 8 is a diagram illustrating an exemplary assembly process for a display case door according to implementations of the present disclosure. To install a display case door, panel assembly 20 may need to be trimmed, for example, for a custom-made refrigerated case. Panel assembly 20 may be cut to length, for example, along cut line 'c-c' (e.g., parallel to the openings at ends 12*a* and 12*b*). Panel assembly 20 may also be cut to reduce the width of the panel assembly 20, for example, along cut line 'b-b.' Caps 22 are installed by coupling body portion 32 of caps 22 to the ends of panel assembly 20. One cap is coupled to end 12*a*. Another cap 22 is coupled to panel assembly 20 at a new, cut end, created from cutting panel assembly 22 along line 'c-c.' The uniform cross section of panel assembly 20 allows cap 22 to be installed at the cut portion without modifying or adapting cap 22. Caps 22 can be installed by using an adhesive or by mechanical coupling (e.g., snap fit/friction fit). Edge guards 17 are cut to length to match the new length of panel assembly 20 and coupled to the edges of the panel assembly. Handle 16 is installed in panel assembly 20 by using an adhesive or mechanical fasteners (e.g., bolt/screw). The customized display case door can be mounted on a frame of a refrigerated display case.

The design of the panel assembly to have a substantially consistent cross-section along its entire length allows the doors to be customized to more precisely fit refrigerated case openings. The ability to customize door sizes at the installation site may reduce manufacturing costs and provide many benefits, such as increased customization and versatility of the display case door. Also, the ability to customize door sizes may provide improved door fit, e.g., for retrofitting doors to existing cases. Improved door fit may translate to better thermal insulation and improved energy efficiency.

The elements and assemblies discussed herein may be constructed from any of a wide variety of materials that provide sufficient strength or durability, in any of a wide variety of colors, textures, and combinations. Further, elements shown as integrally formed may be constructed of multiple parts or elements.

As used herein, the terms "generally," "substantially," and similar terms are intended to have a meaning consistent with the common and accepted usage by those of ordinary skill in the art to which the subject matter of this disclosure pertains. For example, the use of such terms indicates values or measurements that are within acceptable engineering, machining, or measurement tolerances within the art. Accordingly, these terms should be interpreted as indicating that insubstantial or inconsequential modifications or alterations of the subject matter described and claimed are considered to be within the scope of the invention as recited in the claims.

It should be noted that the orientation of various elements may differ according to other exemplary implementations, and that such variations are intended to be encompassed by the present disclosure.

While a number of examples have been described for illustration purposes, the foregoing description is not intended to limit the scope of the invention, which is defined by the scope of the appended claims.

What is claimed is:

1. A display case door, comprising:

a panel assembly comprising:

a first transparent pane comprising, in cross-section, respective flanges extending from each of a first edge and a second edge of a shaped portion, the shaped portion extending out of a plane formed by the flanges, and a second transparent pane adhered to both flanges of the first pane to define a space between facing surfaces of the second transparent pane and the shaped portion of the first transparent pane and extending between openings at opposite ends of the panel assembly;

caps coupled to the panel assembly and covering the openings at each of the first end and second end, each of the caps comprising:

a body portion shaped to correspond with the cross-section of the panel assembly, the body portion configured to couple to both the first transparent pane and the second transparent pane at an end of the panel assembly, thereby, covering one of the openings, a cap flange extending away from the body portion;

a hinge coupled to one of the flanges of the first transparent pane;

a door handle secured to a surface of one of the flanges of the first pane; and an edge guard coupled along an edge of at least one of the flanges, wherein the edge guard includes a flexible wiper configured to form a seal with another surface with the door in a closed position.

2. The display case door of claim 1, wherein the first pane comprises acrylic or polyethylene terephthalate (PETG).

3. The display case door of claim 1, wherein the second pane is welded to the flanges.

4. The display case door of claim 1, wherein the flanges and shaped portion, together, form a top hat-shaped cross-section.

5. The display case door of claim 1, wherein the handle is secured to the surface of the one of the flanges with an adhesive.

6. The display case door of claim 1, wherein the handle is secured to the one of the flanges with a mechanical fastener.

7. The display case door of claim 1, wherein edges of the second pane are substantially coextensive with edges of the flanges of the first pane.

8. The display case door of claim 1, wherein the first pane is an extruded plastic material having a substantially constant cross-section along its length parallel to the flanges.

9. The display case door of claim 1, wherein the caps are coupled with an adhesive.

10. The display case door of claim 1, wherein the caps are mechanically coupled to the panel assembly.

11. A display case comprising:

a frame; and a first display case door and a second display case door mounted to the frame, each of the first display case door and the second display case door comprising:

a panel assembly comprising:

a first transparent pane comprising, in cross-section, respective flanges extending from each of a first edge and a second edge of a shaped portion, the shaped portion extending out of a plane formed by the flanges, and a second transparent pane adhered to both flanges of the first pane to define a space between facing surfaces of the second transparent pane and the shaped portion of the first transparent pane and extending between openings at opposite ends of the panel assembly;

caps coupled to the panel assembly and covering the openings at each of the first end and second end, each of the caps comprising:

a body portion shaped to correspond with the cross-section of the panel assembly, the body portion configured to couple to both the first transparent pane and the second transparent pane at an end of the panel assembly, thereby, covering one of the openings, and a cap flange extending away from the body portion;

a hinge coupled to one of the flanges of the first transparent pane, the hinge configured to couple to the hinge receiving portion;

a door handle secured to a surface of one of the flanges of the first pane; and an edge guard coupled along an edge of at least one of the flanges, the edge guard comprising a flexible wiper;

wherein the first door and the second door are positioned within the frame such that the flexible wiper of the first door forms a seal with the flexible wiper of the second door of each door, with both doors in a closed position.

12. The display case of claim 11, wherein edges of the second pane are substantially coextensive with edges of the flanges of the first pane.

13. The display case of claim 11, wherein the first pane is an extruded plastic material having a substantially constant cross-section along its length parallel to the flanges.

14. The display case of claim 11, wherein the flanges and shaped portion, together, form a top hat-shaped cross-section.

* * * * *